US011739570B2

(12) United States Patent
Debroucke et al.

(10) Patent No.: US 11,739,570 B2
(45) Date of Patent: Aug. 29, 2023

(54) PARTIAL-OPENING SYSTEM FOR A MOTOR VEHICLE OPENING LEAF

(71) Applicants: U-SHIN FRANCE, Creteil (FR); U-Shin Ltd., Tokyo (JP)

(72) Inventors: Francois Debroucke, Abbeville (FR); Jean Marc Verbrugghe, Abbeville (FR); Herve Boucher, Abbeville (FR); Kanae Okabe, Tokyo (JP)

(73) Assignee: U-SHIN FRANCE, Creteil (FR)

( * ) Notice: Subject to any disclaimer, the term of this patent is extended or adjusted under 35 U.S.C. 154(b) by 388 days.

(21) Appl. No.: 16/865,932

(22) Filed: May 4, 2020

(65) Prior Publication Data

US 2020/0263459 A1 Aug. 20, 2020

Related U.S. Application Data

(63) Continuation of application No. PCT/EP2018/078800, filed on Oct. 19, 2018.

(30) Foreign Application Priority Data

Nov. 2, 2017 (FR) ..... 17/71161

(51) Int. Cl.
*E05B 81/20* (2014.01)
*E05B 81/04* (2014.01)
(Continued)

(52) U.S. Cl.
CPC ..... *E05B 81/20* (2013.01); *E05B 81/05* (2013.01); *E05B 81/42* (2013.01); *E05B 83/36* (2013.01);
(Continued)

(58) Field of Classification Search
CPC ..... E05B 17/10; E05B 81/05; E05B 81/20; E05B 81/42; Y10T 292/1099;
(Continued)

(56) References Cited

U.S. PATENT DOCUMENTS 2,785,916 A * 3/1957 Mutti ..... E05B 81/34 292/144
3,274,732 A * 9/1966 Murakami ..... E05F 15/622 49/300
(Continued)

FOREIGN PATENT DOCUMENTS

DE 3908995 A1 * 7/1990
DE 19835994 A1 * 2/2000 ..... E05B 81/20
(Continued)

OTHER PUBLICATIONS

International Search Report for International Application PCT/EP2018/078800, dated Jan. 2, 2019.

*Primary Examiner* — Carlos Lugo
(74) *Attorney, Agent, or Firm* — Burris Law, PLLC

(57) ABSTRACT

A partial-opening system for a motor vehicle opening leaf includes an actuator having a fixed frame mounted on the opening leaf and an actuating element moveable between a retracted position in which the opening leaf is in a closed position, and a deployed position in which a free end of the actuating element is adapted to bear on the central pillar in order to partially open the opening leaf. The system further includes a device for retaining the opening leaf having a retaining end-piece arranged at the free end of the actuating element of the actuator and a retaining element adapted to be mounted on the central pillar of the vehicle, the retaining device adapted to maintain the opening leaf in its retracted position and to release the opening leaf in the case of an opening action on the opening leaf on the part of the user.

20 Claims, 5 Drawing Sheets

(51) Int. Cl.
*E05F 15/72* (2015.01)
*E05B 81/42* (2014.01)
*E05B 83/36* (2014.01)

(52) U.S. Cl.
CPC ..... *E05F 15/72* (2015.01); *E05Y 2201/426* (2013.01); *E05Y 2201/47* (2013.01); *E05Y 2201/638* (2013.01); *E05Y 2400/81* (2013.01); *E05Y 2900/531* (2013.01); *Y10T 292/11* (2015.04)

(58) Field of Classification Search
CPC .. Y10T 292/11; Y10T 292/1021; E05F 15/00; E05F 15/622; E05F 1/00
USPC ..... 296/146.4; 49/276
See application file for complete search history.

(56) References Cited

U.S. PATENT DOCUMENTS 3,300,239 A * 1/1967 Dinkin ..... E05C 17/56 292/251.5
3,398,484 A * 8/1968 Toru ..... E05F 15/622 49/281
4,644,693 A * 2/1987 Wang ..... E05F 15/619 49/358
5,369,911 A * 12/1994 Fortunato ..... G07C 9/00182 49/357
5,546,777 A * 8/1996 Liu ..... E05C 1/06 292/DIG. 60
6,338,536 B1 * 1/2002 Ueno ..... E05F 15/60 49/478.1
6,711,856 B1 * 3/2004 Hoffman ..... E05F 1/105 49/386
9,771,750 B2 * 9/2017 Held ..... E05F 1/105
9,995,066 B1 * 6/2018 Ottolini ..... E05F 15/619
10,633,893 B2 * 4/2020 Harajli ..... E05B 81/20
11,008,797 B2 * 5/2021 Termine ..... E05F 15/622
2012/0204490 A1 8/2012 Lanigan et al.
2019/0292818 A1 * 9/2019 Cumbo ..... E05C 17/003

FOREIGN PATENT DOCUMENTS

DE 20220187 U1 * 4/2003 ..... E05B 17/10
DE 202007006687 9/2008
DE 102008042979 A1 * 9/2009 ..... E05F 11/405
DE 202011107862 U1 * 6/2012 ..... E05B 17/10
DE 102011008992 7/2012
DE 102015003917 9/2016
DE 202017104564 10/2017
DE 102016124117 A1 * 6/2018 ..... E05F 3/14
DE 102017108752 A1 * 10/2018 ..... E05B 81/14
EP 3073040 9/2016
FR 1346741 A * 12/1963 ..... E05B 17/10
FR 3078547 A1 * 9/2019
JP 2004003774 A * 1/2004

* cited by examiner

PARTIAL-OPENING SYSTEM FOR A MOTOR VEHICLE OPENING LEAF

CROSS-REFERENCE TO RELATED APPLICATIONS

This application is a continuation of International Application No. PCT/EP2018/078800, filed on Oct. 19, 2018, which claims priority to and the benefit of FR 17/71161, filed on Nov. 2, 2017. The disclosures of the above applications are incorporated herein by reference.

FIELD

The present disclosure relates to a system to drive a motor vehicle opening leaf between a closed position and a partially opened position.

BACKGROUND

The statements in this section merely provide background information related to the present disclosure and may not constitute prior art.

Generally, a motor vehicle opening leaf has a first front edge which is adapted to be mounted pivotably on a framework of the motor vehicle, about an opening axis, and a second opposed rear edge which is designed to extend completely parallel to a central pillar of the motor vehicle.

A type of motor vehicle opening leaf which is deprived of a mechanical door handle is known, the handle being replaced by an electrical opening device.

The electrical opening device of the opening leaf can be controlled by a contactless interface or by an interface of the tactile type with a capacitive or inductive sensor, for example, to allow the user to control the opening of the opening leaf.

In addition, to overcome the absence of a mechanical handle and thus of a gripping element allowing the opening of the opening leaf, the opening leaf is equipped with a motorized partial-opening system, or ejection system, which is designed to drive the opening leaf from a closed position, in which the opening leaf is flush with the peripheral frame formed by the body of the vehicle, to a partially opened position to allow a user to grab the edge of the opening leaf with the aim of opening the opening leaf completely.

Various partial-opening systems are known, in particular a system which comprises a rack secured to the framework of the vehicle and an actuator secured to the opening leaf.

The actuator comprises a frame which is mounted on the opening leaf and a pinion which engages with the rack, the pinion being driven by an electric motor. Thus, the rotation of the pinion makes it possible to drive the opening leaf to move between its closed position and a partially opened position.

The rack-type partial-opening system described here is arranged in the vicinity of the front edge of the opening leaf and of the hinge of the opening leaf so as not to impede access to the passenger compartment of the vehicle.

It is also known to propose an electric jack-type automated opening system which comprises an electric jack comprising a body mounted on the framework of the vehicle and a moveable rod whose free end is mounted on the opening leaf. Thus, the jack is adapted to drive the opening leaf between its closed position and its partially opened position.

The jack-type partial-opening system described here is arranged in the vicinity of the front edge of the opening leaf and of the hinge of the opening leaf so as not to impede access to the passenger compartment of the vehicle.

A system similar to the one described above is known from DE 10 2015 003917.

Another system managing various motorized functions of a door via electric actuators, one of which actuates a push member to open a door is also known from DE 20 2017 104564.

Eventually, a method and a closure system for opening and/or closing a door and a control system is also known from DE 10 2011 008992.

A disadvantage of the automated partial-opening systems described above is that, in the event of failure, the opening leaf is at risk of no longer being manipulable manually by the user, the opening leaf being at risk of remaining blocked in an open or closed position. In addition, the partial-opening position of prior art is unstable and there is no information on whether the door has been pulled by the car user or not.

SUMMARY

This section provides a general summary of the disclosure and is not a comprehensive disclosure of its full scope or all of its features.

The present disclosure provides a partial-opening system for a motor vehicle opening leaf, the partial-opening system comprising an opening leaf which has a first edge adapted to be mounted pivotably on a framework of a motor vehicle, about an opening axis, and a second opposed edge which is designed to extend completely parallel to a central pillar of the motor vehicle, the opening leaf being moveable between at least a closed position and a partially opened position to allow a user to grab the second edge of the opening leaf with the aim of opening the opening leaf completely.

The partial-opening system comprises:

an actuator which comprises a fixed frame mounted on the opening leaf and an actuating element which is moveable between a retracted position in which the actuating element allows the opening leaf to adopt its closed position, and a deployed position in which a free end of the actuating element is adapted to bear on the central pillar in order to partially open the opening leaf, and a device for retaining the opening leaf which comprises a retaining end-piece arranged at the free end of the actuating element of the actuator and a retaining element adapted to be mounted on the central pillar of the vehicle, the retaining device being designed to maintain the opening leaf in its partially opened position and to release the opening leaf in the case of an opening action on the opening leaf on the part of the user.

The partial-opening system according to the present disclosure is arranged in the vicinity of the rear edge of the opening leaf, which increases the lever arm with respect to a partial-opening system arranged in the vicinity of the front edge of the opening leaf, thus allowing a smaller dimensioning of the partial-opening system.

Moreover, the partial-opening system according to the present disclosure is able to be arranged in the vicinity of the lock of the opening leaf, which makes it possible to mount an assembly formed by the actuator and the lock in one step.

Also, the partial-opening system according to the present disclosure is adapted not to block the opening leaf in the event of failure of the actuator.

According to another feature, the device for retaining the opening leaf is of the magnetic or electromagnetic type.

This feature makes it possible to retain the opening leaf in its partially opened position in a reliable manner without untimely opening of the opening leaf while allowing the opening leaf to be released when the user exerts a pulling force.

According to one variant, the device for retaining the opening lever is of the shape co-operation mechanical type.

According to another feature, the actuator is an electric jack, the actuating element of the actuator forming a sliding endless screw which extends completely perpendicularly to the opening axis of the opening leaf.

According to another feature, the retaining end-piece of the retaining device is mounted so as to be free to pivot on the free end of the actuating element of the actuator about an axis which is completely parallel to the opening axis of the opening leaf, in order to promote the connection between said retaining end-piece and the associated retaining element.

According to another feature, the partial-opening system comprises a control device which co-operates with the actuator to selectively control the actuating element of the actuator into its deployed position corresponding to the partially opened position of the opening leaf, or into its retracted position corresponding to the closed position of the opening leaf.

According to another feature, the partial-opening system comprises a control interface which is associated with the control device and which is adapted to allow the user to control the driving of the actuating element of the actuator from its retracted position to its deployed position in order to partially opened the opening leaf.

According to another feature, the control device is adapted to automatically control the actuating element from its deployed position to its retracted position in the case of non-opening of the opening leaf by the user.

According to another feature, the control device is adapted to control a lock in order to lock the opening leaf when the opening leaf is closed automatically in the case of non-opening of the opening leaf.

According to another feature, the partial-opening system comprises a device for detecting opening of the opening leaf which makes it possible to detect an opening of the opening leaf beyond the partially opened position of the opening leaf, and which co-operates with the control device to control the actuating element of the actuator into its retracted position when the opening leaf occupies an open position beyond its partially opened position.

The opening detection device comprises:

a piston which is mounted so as to be slideable transversally in a body adapted to be mounted on the central pillar, between an active position in which the piston is driven by the actuating element during the opening of the opening leaf, and a rest position in which the piston is returned elastically by a spring, a cam which defines a camway co-operating with a follower, the follower being mounted slideably between a rest position and a detection position which corresponds to the active position of the piston, and a contactor which is actuated by the follower when the piston reaches its active position, and which is adapted to send an electric signal to signal an opening action on the opening leaf beyond its partially opened position.

The device for detecting opening of the opening leaf has the advantage of being insensitive to vibrations and to small movements of the opening leaf which could pass for an actual opening of the opening leaf.

According to another feature, the actuating element of the actuator is adapted to be drawn from its deployed position to its retracted position during the closure of the opening leaf by the user in the event of failure of the partial-opening system.

The present disclosure also relates to an assembly comprising a partial-opening system of the type described above and a lock for an opening leaf.

The present disclosure can optionally comprise an opening leaf which comprises a light-emitting device on the edge of the opening leaf where the lock is situated, said light-emitting device being housed outside the lock so as to be visible when said opening leaf is in the partially opened position.

Furthermore, the present disclosure can optionally comprise a light-emitting device on the edge of the opening leaf which is housed in or around a recess of the door edge, said recess serving as a gripping element for opening said opening leaf.

The present disclosure also relates to a motor vehicle comprising a partial-opening system of the type described above.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
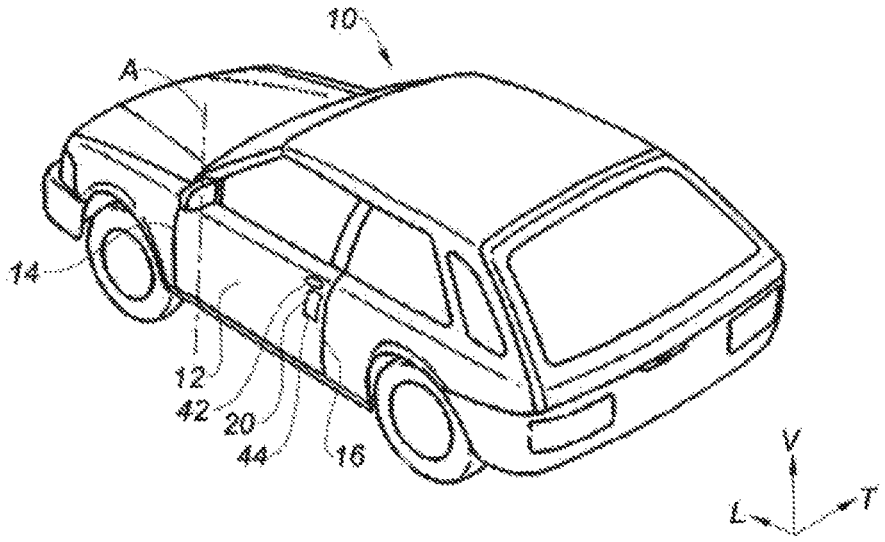
FIG. 1 is a perspective view which illustrates a motor vehicle comprising an opening leaf in the closed position which is equipped with a partial-opening system according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the description and the claims, in order to clarify the description and the claims, the terms longitudinal, vertical and transverse will be adopted in a non-limiting manner with reference to the three-dimensional axis system L, V, T indicated in the figures, the axis L of which is parallel to the general direction of the vehicle.

In all of these figures, identical or analogous references represent identical or analogous members or sets of members.

FIG. 1 depicts a motor vehicle 10 which comprises an opening leaf 12.

The opening leaf 12 has a first front edge 14 which is mounted pivotably on a framework (not visible) of the vehicle 10, about a vertical opening axis A, and a second opposed rear edge 16 which is designed to extend completely parallel to a central pillar 18 of the vehicle 10.

Figure 2:
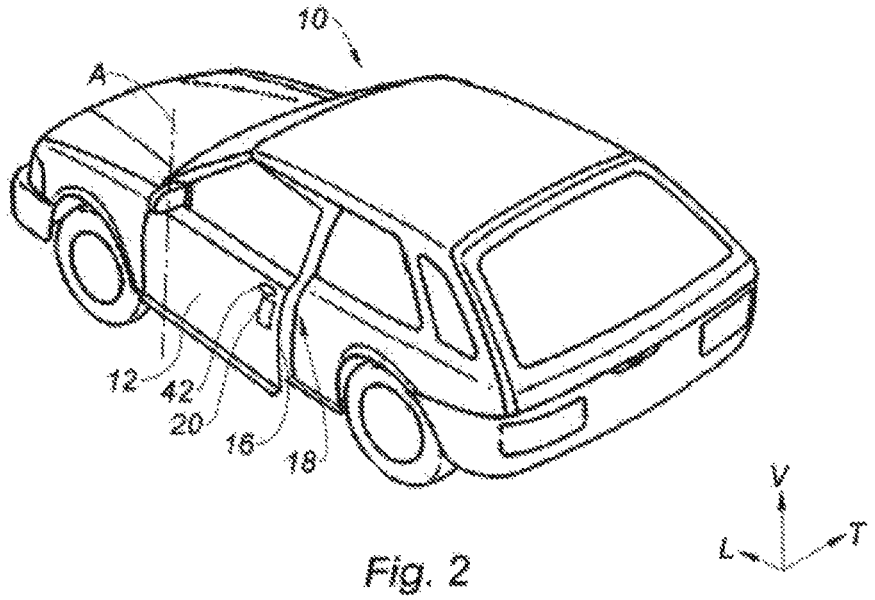
FIG. 2 is a perspective view which illustrates the vehicle of FIG. 1 with the opening leaf in the partially opened position.

The opening leaf 12 is mounted moveably between a closed position illustrated in FIG. 1, in which the external covering skin of the opening leaf 12 is flush with the body of the vehicle 10, and a partially opened position illustrated in FIG. 2, in which the second edge 16 of the opening leaf is freed transversally from the central pillar 18 to allow a user to grab the second edge 16 of the opening leaf with the aim of opening the opening leaf 12 completely.

The partially opened position of the opening leaf 12 corresponds to an opening of the opening leaf 12 of the order of 25 to 50 millimetres with respect to its closed position.

The vehicle 10 is equipped with a partial-opening system 20 which comprises an actuator 22 designed to drive the opening leaf 12 between its closed position and its partially opened position.

Figure 3:
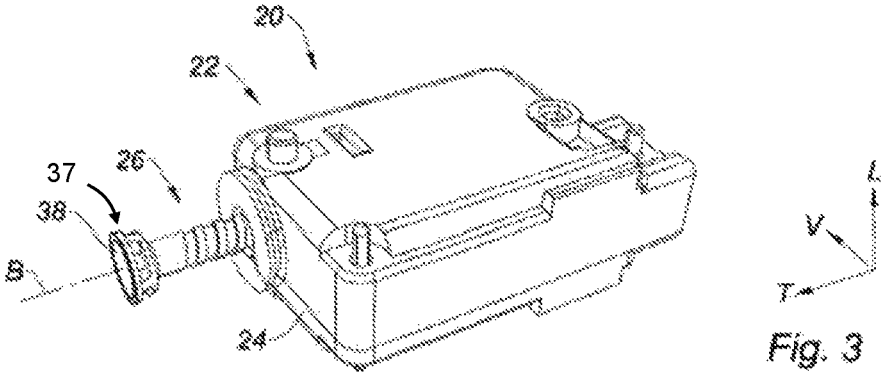
FIG. 3 is a detailed perspective view which illustrates the actuator of the partial-opening system of FIG. 1 which comprises an electric motor and an actuating element.
Figure 4:
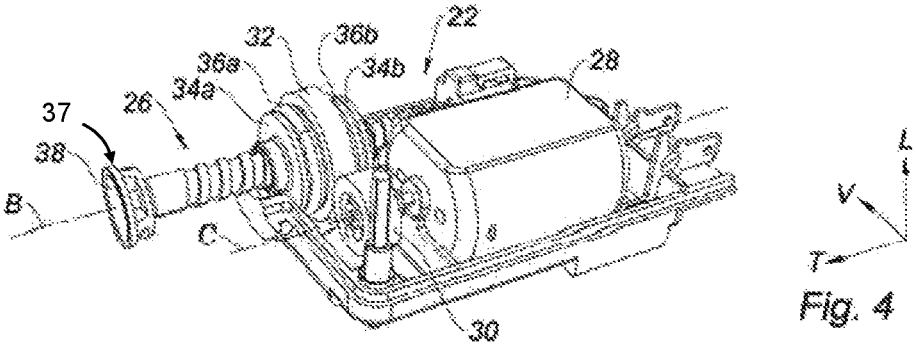
FIG. 4 is a perspective view similar to that of FIG. 3, which illustrates the actuator of the partial-opening system without its cover.
Figure 5:
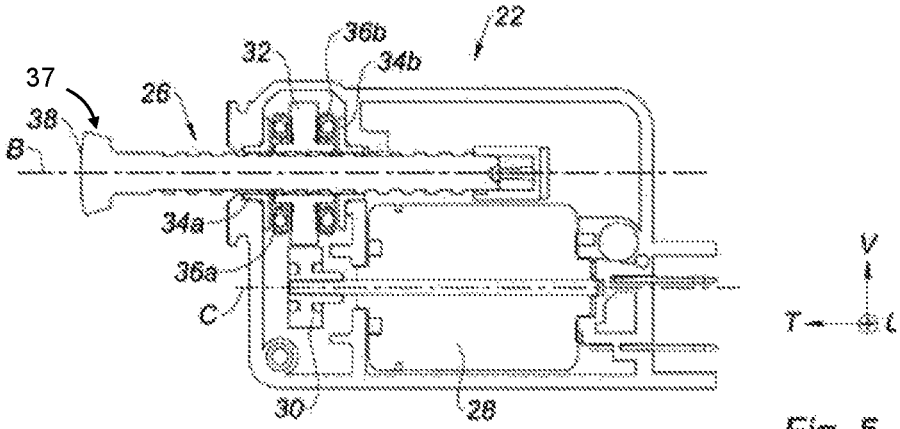
FIG. 5 is a cross-sectional view which illustrates the actuator of the partial-opening system of FIG. 1.

To this end, the actuator 22, illustrated in detail in FIGS. 3 to 5, comprises a fixed frame 24 mounted on the opening leaf 12 and a moveable actuating element 26.

According to another form, the actuator 22 is an electric jack, and the actuating element 26 is an endless screw which extends completely perpendicularly to the opening axis A of the opening leaf 12, along an axis B.

As can be seen in FIGS. 4 and 5, the actuator 22 comprises an electric motor 28 which rotates a drive wheel 30 about an axis C parallel to the actuating element 26, the drive wheel 30 rotating a nut 32 by friction about the axis B.

The nut 32 is screwed onto the actuating element 26 forming the endless screw.

Moreover, the nut 32 is blocked against axial translation along the axis B of the actuating element 26 by a first bearing 34*a* and a second bearing 34*b* which are arranged on either side of the nut 32 and which are each mounted in a housing formed by the frame 24 of the actuator 22.

Also, a first thrust ball bearing 36*a* is interposed axially between the first bearing 34*a* and a first flank of the nut 32 and a second thrust ball bearing 36*b* is interposed axially between the second bearing 34*b* and an opposed second flank of the nut 32.

Thus, the rotation of the nut 32 by the drive wheel 30 makes it possible for the actuating element 26 to be driven with an axial translational movement along the axis B.

Figure 6:
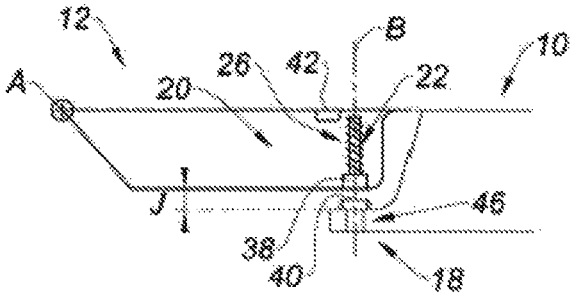
FIG. 6 is a schematic view in longitudinal section which illustrates the opening leaf for FIG. 1 in its closed position and the actuating element of the actuator in its retracted position.
Figure 6:
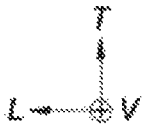
Figure 7:
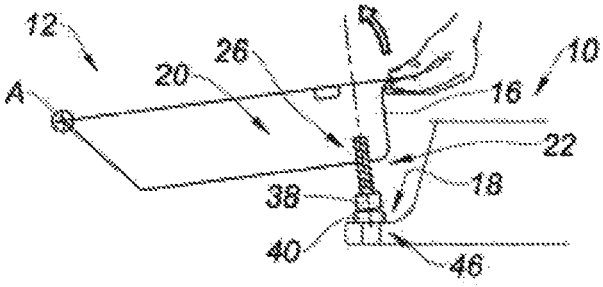
FIG. 7 is a schematic view in longitudinal section which illustrates the opening leaf of FIG. 1 in its partially opened position and the actuating element of the actuator in its deployed position.
Figure 7:
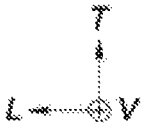
Figure 8:
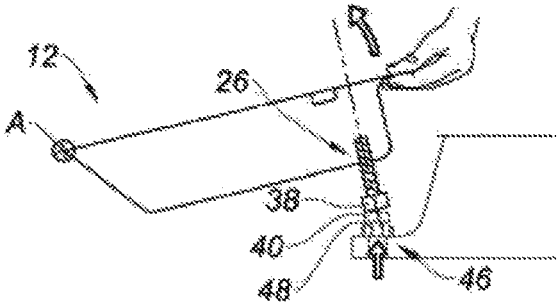
FIG. 8 is a schematic view in longitudinal section which illustrates the opening leaf of FIG. 1 in its partially opened position during opening, and the actuating element of the actuator in its deployed position.
Figure 8:
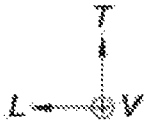
Figure 9:
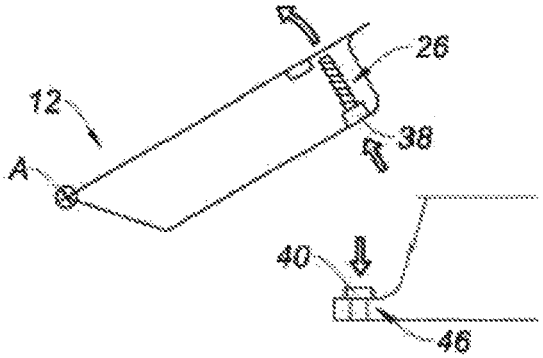
FIG. 9 is a schematic view in longitudinal section which illustrates the opening leaf of FIG. 1 in its open position and the actuating element of the actuator in its retracted position.
Figure 9:
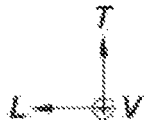

More particularly, the actuating element 26 is moveable between a retracted position illustrated in FIGS. 6 and 9 and a deployed position illustrated in FIGS. 7 and 8.

According to another aspect of the present disclosure, the partial-opening system 20 comprises a retaining device 37 for retaining the opening leaf 12 which is designed to maintain the opening leaf in its partially opened position and to release the opening leaf 12 in the case of an opening action on the opening leaf on the part of the user.

To this end, the retaining device 37 comprises a retaining end-piece 38 which is arranged at the free end of the actuating element 26 of the actuator 22 and a retaining element 40 which is mounted on the central pillar 18 of the vehicle 10.

As can be seen in FIG. 7, the retaining element 40 is arranged facing the retaining end-piece 38, such that, when the actuating element 26 is driven towards its deployed position, the retaining end-piece 38 bears on the retaining element 40 so as to move the opening leaf 12 away from its closed position into its partially opened position.

Figure 10:
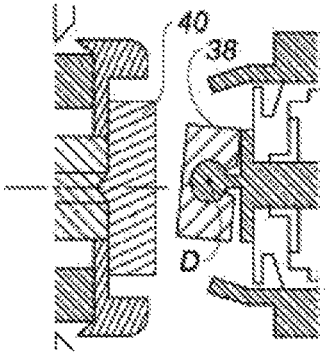
FIG. 10 is a detailed cross-sectional view in longitudinal section which illustrates a device for retaining the opening leaf.

According to one form of the present disclosure, the retaining end-piece 38 is mounted so as to be free to pivot on the free end of the actuating element 26 of the actuator 22 about a vertical axis D which is completely parallel to the opening axis A of the opening leaf 12, as can be seen in FIG. 10.

This feature allows an offsetting of the retaining end-piece 38 with respect to the actuating element 26 during the opening of the opening leaf 12 in order to promote the connection between the retaining end-piece 38 and the associated retaining element 40.

According to one form of the present disclosure, the retaining device 37 for retaining the opening leaf 12 is of the magnetic type.

More particularly, the retaining end-piece 38 is a permanent magnet and the retaining element 40 mounted on the central pillar 18 is made of a ferromagnetic material.

The retaining end-piece 38 is in one form equipped with a damper pad (not shown), made of rubber for example, to damp the contact between the retaining end-piece 38 and the retaining element 40.

The power of the magnet forming the retaining end-piece 38 is sufficiently high to retain the opening leaf 12 in its partially opened position, in particular in the case of wind, and is sufficiently low to allow the retaining end-piece 38 and the retaining element 40 to be detached when the user exerts a pull on the opening leaf 12 with the aim of opening the opening leaf 12.

To allow the user to partially opened the opening leaf 12, the partial-opening system 20 according to the present disclosure comprises an assembly formed by a control interface 42 which is associated with a control device 44, this assembly visible in FIG. 1, allowing the user to control the driving of the actuating element 26 of the actuator 22 from its retracted position to its deployed position in order to partially opened the opening leaf 12.

The control interface 42 is, for example, a tactile sensor of the push-button type which is arranged on the opening leaf 12 or on the central pillar 18 of the vehicle.

However, the control interface 42 can also be produced by a sensor of the capacitive type designed to detect the movement of a hand, or any other sensor adapted to capture an intention of opening the opening leaf 12.

The control device 44 co-operates with the actuator 22 to selectively control the actuating element 26 of the actuator 22 into its deployed position corresponding to the partially opened position of the opening leaf 12, or into its retracted position corresponding to the closed position of the opening leaf 12.

According to another aspect of the present disclosure, the partial-opening system 20 comprises a device 46 for detecting opening of the opening leaf 12 which makes it possible to detect an opening of the opening leaf 12 beyond the partially opened position of the opening leaf.

The opening detection device 46 co-operates with the control device 44 to control the actuating element 26 of the actuator 22 into its retracted position when the opening leaf 12 occupies an open position beyond its partially opened position.

In other words, the opening detection device 46 for detecting opening of the opening leaf 12 is designed to detect an intentional opening action on the opening leaf 12 on the part of the user, from the partially opened position of the opening leaf 12.

Figure 11:
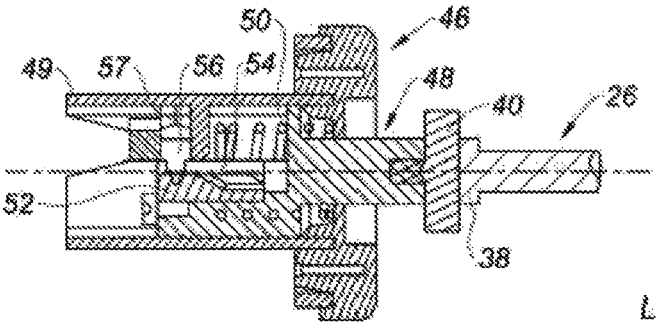
FIG. 11 is a cross-sectional view which illustrates the device for retaining the opening leaf comprising a piston in the active position.
Figure 12:
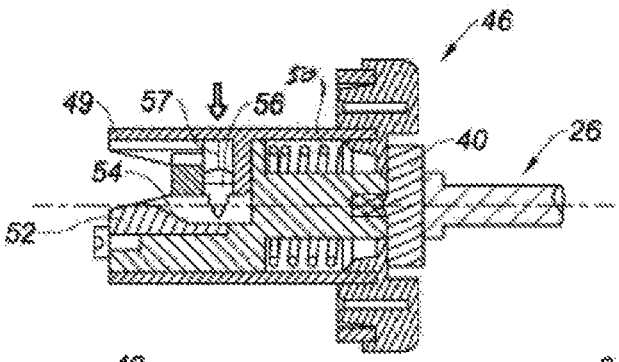
FIG. 12 is a cross-sectional view similar to that of FIG. 11 which illustrates the piston of the retaining device in a rest position.

To this end, the opening detection device 46 illustrated in detail in FIGS. 11 and 12 comprises a piston 48 which extends transversally in a body 49 mounted on the central pillar 18. The axis of the piston 48 and that of the actuating element 26 are in one form co-incident in order to facilitate detection and make savings in terms of compactness.

The free end of the piston 48 can bear the retaining element 40.

The piston 48 is able to slide between an active position illustrated in FIG. 11, in which the piston 48 is driven by the actuating element 26 during the opening of the opening leaf 12, and a rest position illustrated in FIG. 12, in which the piston 48 is returned elastically by a spring 50.

Also, the opening detection device 46 comprises a cam 52 which delimits a camway 54 co-operating with a follower 56.

The follower 56 is mounted so as to be slideable perpendicular to the piston 48 between a rest position illustrated in FIG. 12 and a detection position illustrated in FIG. 11 which corresponds to the active position of the piston 48 and therefore to an opening position of the opening leaf 12 beyond its partially opened position.

In its detection position, the follower 56 actuates a contactor 57 which sends an electrical signal to the control device 44 to signal an action of opening the opening leaf 12 beyond its partially opened position.

Thus, when the actuating element 26 occupies its deployed position and the opening leaf 12 occupies its partially opened position, corresponding to FIG. 12, it is noted that vibrations of the opening leaf or slight oscillations of the opening leaf 12, caused by wind, for example, do not allow a follower 56 to actuate the associated contactor 57.

Conversely, the follower 56 actuates the contactor 57 in the case of intentional opening of the opening leaf 12, the spring 50 being calibrated so as to exert a sufficiently large return force to overcome any untimely movement of the piston 48, which would correspond to a non-intentional opening of the opening leaf 12.

There is another preferred embodiment so as to avoid generating any rebound of the retaining element 40 upon ejection of the door. The principle is the same as the embodiment above with the follower 56 but the detection device is a detection rod d co-axial with the piston 48 and included inside said piston 48. A double piston system is obtained that allows realizing the door position sensor and is necessary to command piston 48 retraction back to initial position.

Structurally, on one side, the detection rod d is kept in contact with the door retaining end-piece 38 by a rod spring. The other side of the rod spring 50 is able to be in contact with the follower 56 depending on the shape of the cam (52). With reference to FIG. 11, if the door with the retaining end-piece 38 is pulled, then, the detection rod d co-axial with the retaining element 40 would also lose contact with the door, and the door ejection system information is given (cf. FIG. 11 with actuated contactor 57). If, after a while, the door is pulled back to initial position, then the co-axial rod would lead to status change of the contactor 57 informing the system that the door has not been pulled by the user.

Thus, the free end of the piston 48 of the opening detection device 46 may or may not bear the retaining element 40.

With reference to FIGS. 6 to 9, an example of operation of the partial-opening system 20 according to the present disclosure is described below in a chronological manner, during an opening cycle of the opening leaf 12.

FIG. 6 illustrates the opening leaf 12 in its closed position. The user actuates the control interface 42, by pressing on the push-button 42, and simultaneously the control device 44 controls the driving of the actuating element 26 of the actuator 22 from its retracted position to its deployed position.

During the deployment of the actuating element 26, the retaining end-piece 38 comes into contact with the associated retaining element 40 to allow the actuating element 26 to bear on the central pillar 18 in order to drive the opening leaf 12 from its closed position to its partially opened position illustrated in FIG. 7.

The opening leaf 12 is partially opened and is retained in its partially opened position by the retaining end-piece 38 and the associated retaining element 40 in order to avoid unsolicited closing or opening of the opening leaf 12.

With reference to FIG. 7, the user grabs the second edge 16 of the opening leaf 12, which can be likened to a static handle, with the aim of opening the opening leaf 12 completely.

The piston 48 of the opening detection device 46 for detecting opening of the opening leaf 12, illustrated in FIG. 8, is driven from its rest position to its active position such that an electrical signal is sent to the control device 44 to signal an action of opening the opening leaf 12 beyond its partially opened position.

The control device 44 controls the driving of the actuating element 26 from its deployed position to its retracted position, as can be seen in FIG. 9, and the piston 48 is returned elastically to its rest position.

Also, the force exerted by the user on the opening leaf 12 detaches the retaining end-piece 38 from the retaining element 40 to allow the complete opening of the opening leaf 12.

As can be seen in FIG. 6, it will be noted that a transverse clearance J is provided, in the closed position of the opening leaf 12 between the retaining end-piece 38 and the associated retaining element 40, which is greater than the slamming over-travel of the opening leaf 12 in order to avoid a collision between the retaining end-piece 38 and the associated retaining element 40 in the case of slamming of the opening leaf 12.

According to another feature of the present disclosure, the control device 44 is adapted to automatically control the actuating element 26 from its deployed position to its retracted position in the case of non-opening of the opening leaf 12 by the user.

For this purpose, the time from which the opening leaf 12 occupies its partially opened position, illustrated in FIG. 7, is calculated. If this time exceeds a predetermined value which corresponds to a non-opening of the opening leaf 12, the opening leaf 12 is then automatically closed again by the actuator 22. From this position of first notch on the door latch, also called intermediate notch, it is quite possible to consider a motorized closure to the second notch of the latch lock bolt to obtain a complete closure of the opening. The device according to the invention, associated with a motorized closure (also called "cinching") allows, from the deployed position, to proceed to a motorized closure of the door in total autonomy. Thus it allows, after an opening command not followed by a door pull by the user, to completely re-secure the car by bringing back the door to initial fully closed position.

Figure 15:
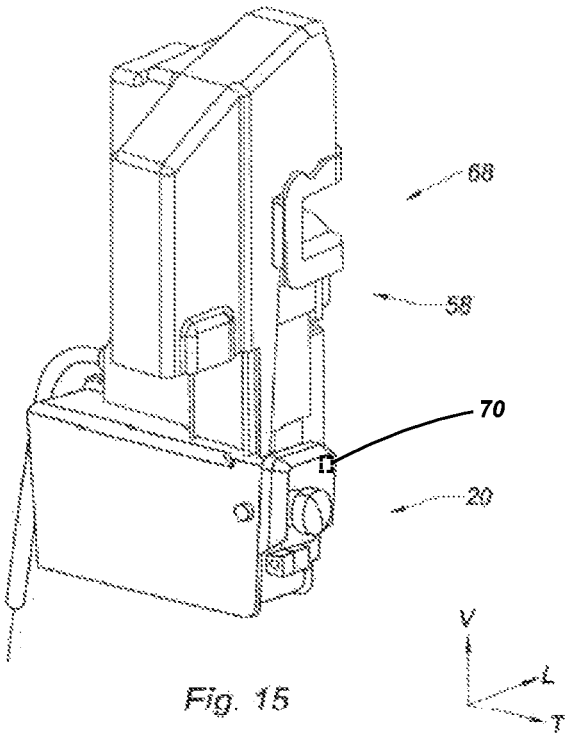
FIG. 15 is a perspective view which illustrates an assembly comprising the partial-opening system according to the present disclosure and an opening lock of the opening leaf.
Figure 16:
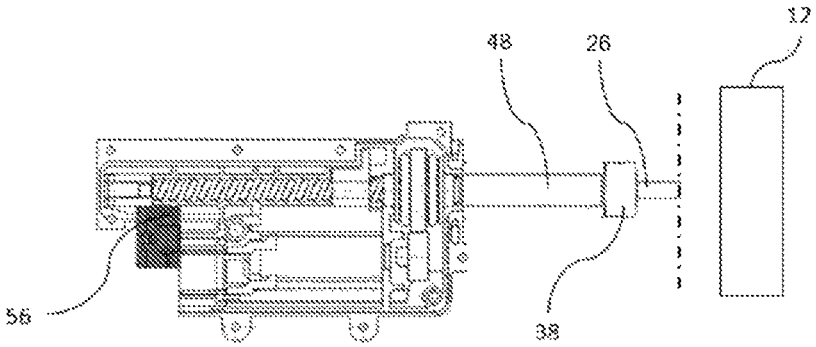
FIG. 16 is a cross-sectional view which illustrates partially the actuator of the partial-opening system and the device for retaining the opening leaf.

In a complementary manner, the control device 44 is adapted to control a lock 58, visible in FIG. 15, in order to lock the opening leaf 12 when the opening leaf 12 is closed automatically in the case of non-opening of the opening leaf 12, as described above.

Moreover, in the event of failure of the partial-opening system 20, the actuating element 26 of the actuator 22 is adapted to be driven manually by the user from its deployed position to its retracted position during the closure of the opening leaf 12, in order that the opening leaf 12 does not remain locked in the partially opened position, for example.

Specifically, as can be seen in FIG. 5, the assembly formed by the nut 32, the bearings 34*a*, 34*b* and the thrust ball bearings 36*a*, 36*b* allow the actuating element 26 to be driven from its deployed position to its retracted position by axial pressure on the actuating element 26.

According to a first variant of the present disclosure, the retaining device 37 for retaining the opening leaf 12 is of the shape-co-operation mechanical type, not being magnetic as described above.

Figure 13:
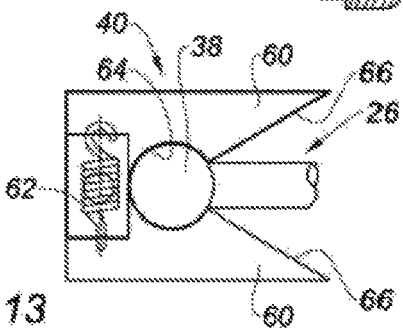
FIGS. 13 and 14 are schematic views which illustrate the device for retaining the opening leaf of the shape-co-operation mechanical type.
Figure 14:
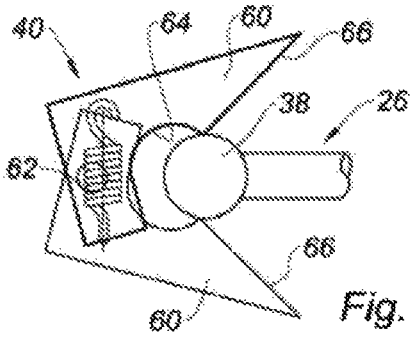

According to this first variant, with reference to FIGS. 13 and 14, the retaining element 40 comprises two jaws 60 which form a clamp and which are returned elastically into a closed position by a spring 62.

The jaws 60 delimit between them a housing 64 adapted to retain the retaining end-piece 38 of the actuating element 26.

Also, each jaw 60 forms a ramp 66 for opening the clamp.

In a complementary manner, the retaining end-piece 38, which is arranged on the free end of the actuating element 26, has a shape complementary to the shape of the housing 64, here a completely cylindrical shape.

Thus, when the actuating element 26 is driven from its retracted position to its deployed position, in order to partially opened the opening leaf 12, the retaining end-piece 38 separates the jaws 60 against the action of the spring 62, as can be seen in FIG. 14, until the retaining end-piece 38 is trapped in the housing 64 of the retaining element 40 provided for this purpose.

It will be understood that, to detach the retaining element 40 and the retaining end-piece 38, the user must exert a force during the opening of the opening leaf 12 which is capable of separating the jaws 60 of the device for retaining the opening leaf 12.

According to a second variant of the present disclosure (not shown), the device for retaining the opening leaf 12 is of the electromagnetic type.

According to this variant, where the retaining element 40 is borne by the free end of the piston 48, the retaining end-piece 38, which is arranged on the free end of the actuating element 26, is an electromagnet which is energized during the driving of the opening leaf 12 from its closed position to its partially opened position in order to secure the retaining element 40 to the retaining end-piece 38.

Conversely, when the opening detection device 46 for detecting opening of the opening leaf 12 detects an intention to open the opening leaf 12, the electromagnet is no longer energized in order to detach the retaining element 40 from the retaining end-piece 38.

Finally, the present disclosure also relates to an assembly 68 comprising a partial-opening system 20 of the type described above and a lock 58 for an opening leaf 12.

In an optional manner, the opening leaf is a door 12 comprising a light-emitting or luminous signal-emitting device 70 such as a light-emitting diode on the edge of the door 12 where a lock 58 is situated. Said light-emitting device 70 is housed outside the lock so as to be visible when the door 12 is in the partially opened position. This advantageously makes it possible to give a user of the assembly 68 according to the present disclosure on a car door 12 the information that the door is partially opened and therefore able to be grabbed.

If the light-emitting device 70 is situated on the surface of the edge of the door 12 corresponding to that of the lock, or even in the lock, the light emitted would not be visible in the partially opened position since it would be masked by the central pillar. Ideally, the light-emitting device 70 is opposite the control interface 42 in order to improve the management of the light source.

In one form of the present disclosure, the light-emitting device 70 on the door edge is housed in or around a recess of the door edge which can be likened to a static handle. Said recess serves as a gripping or handle element for opening the door.

This makes it possible not only to indicate that the opening leaf 12 is in the partially opened position but also to indicate to the user the recess where his hand should be placed in order to open completely the opening leaf 12.

Advantageously, the assembly 68 forms a module which allows simultaneous assembly of a lock 58 and a partial-opening system 20.

The present description of the present disclosure is given by way of non-limiting example. It will be understood that simple mechanical conversions are covered by the present disclosure.

Specifically, according to another variant, the present disclosure relates to a partial-opening system 20 which comprises an actuator 22 comprising a fixed frame 24 mounted on the central pillar 18 of the vehicle 10, and an actuating element 26 which is moveable between a retracted position in which the actuating element 26 allows the opening leaf 12 to adopt its closed position, and a deployed position in which a free end of the actuating element 26 is adapted to bear on the opening leaf 12 in order to partially opened the opening leaf, and a retaining device 37 for retaining the opening leaf 12 which comprises a retaining end-piece 38 arranged at the free end of the actuating element 26 of the actuator 22 and a retaining element 40 adapted to be mounted on the opening leaf 12, the retaining device 37 being designed to maintain the opening leaf 12 in its partially opened position and to release the opening leaf 12 in the case of an opening action on the opening leaf 12 on the part of the user.

Such a mechanical conversion will make it possible to solve space requirement and electrical connection issues, for example.

The system according to the present disclosure can be used in any vehicle provided with an opening leaf.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A partial-opening system for a motor vehicle opening leaf, the partial-opening system comprising an opening leaf which has a first edge adapted to be mounted pivotably on a framework of a motor vehicle, about an opening axis, and an opposed second edge which is designed to extend parallel to a central pillar of the motor vehicle, the opening leaf being moveable between at least a closed position and a partially opened position in order to allow a user to grab the second edge of the opening leaf for opening the opening leaf, the partial-opening system comprising:

an actuator comprising a fixed frame mounted on the opening leaf and an actuating element moveable between a retracted position in which the opening leaf is in the closed position and a deployed position in which a free end of the actuating element is adapted to bear on the central pillar to partially open the opening leaf; and a retaining device comprising a retaining end-piece arranged at the free end of the actuating element of the actuator and a retaining element adapted to be mounted on the central pillar of the motor vehicle, wherein the retaining device is adapted to maintain the opening leaf in the partially opened position and release the opening leaf in a case of an opening action on the opening leaf by the user, wherein the actuator is an electric jack, the actuating element of the actuator forming a sliding endless screw which extends perpendicularly to the opening axis of the opening leaf, wherein the retaining end-piece of the retaining device is mounted so as to be free to pivot on the free end of the actuating element of the actuator only about an axis parallel to the opening axis of the opening leaf, in order to promote the connection between the retaining end-piece and an associated retaining element.

2. The partial-opening system according to claim 1, wherein the retaining device is a magnetic or electromagnetic device.

3. The partial-opening system according to claim 1, wherein the retaining device is of a shape co-operation mechanical configuration.

4. The partial-opening system according to claim 1 further comprising a control device which co-operates with the actuator to selectively control the actuating element into the deployed position corresponding to the partially opened position of the opening leaf, or the retracted position corresponding to the closed position of the opening leaf.

5. The partial-opening system according to claim 4 further comprising a control interface adapted to allow the user to control driving of the actuating element of the actuator from the retracted position to the deployed position.

6. The partial-opening system according to claim 4, wherein the control device is adapted to automatically control the actuating element from the deployed position to the retracted position in a case of non-opening of the opening leaf by the user.

7. The partial-opening system according to claim 6, wherein the control device is adapted to control a lock to lock the opening leaf when the opening leaf is closed automatically in the case of non-opening of the opening leaf.

8. The partial-opening system according to claim 1 further comprising an opening detection device that detects opening of the opening leaf and opening of the opening leaf beyond the partially opened position of the opening leaf, wherein the opening detection device co-operates with a control device to control the actuating element of the actuator into the retracted position when the opening leaf occupies an open position beyond the partially opened position.

9. The partial-opening system according to claim 8, wherein the opening detection device comprises:

a piston which extends transversally in a body mounted on the central pillar, the piston being slideable between an active position in which the piston is driven by the actuating element during opening of the opening leaf and a rest position in which the piston is returned elastically by a spring, a cam defining a camway co-operating with a follower, the follower being mounted slideably between a rest position and a detection position which corresponds to the active position of the piston; and a contactor actuated by the follower when the piston reaches the active position and adapted to send an electrical signal to signal an opening action on the opening leaf beyond its partially opened position.

10. The partial-opening system according to claim 1, wherein the actuating element of the actuator is adapted to be driven from the deployed position to the retracted position during closure of the opening leaf by the user in an event of failure of the partial-opening system.

11. An assembly comprising a partial-opening system according to claim 1 and a lock for an opening leaf.

12. The assembly according to claim 11, wherein the opening leaf comprises a light-emitting device on an edge of the opening leaf where the lock is situated, the light-emitting device being housed outside the lock such that the light-emitting device is visible when the opening leaf is in the partially opened position.

13. The assembly according to claim 12, wherein the light-emitting device is housed in or around a recess of the edge, wherein the recess is a gripping element.

14. A motor vehicle comprising a partial-opening system according to claim 1.

15. The partial-opening system according to claim 1, wherein the retaining element comprises two jaws and a spring, the two jaws cooperating to form a clamp which is returned elastically into a closed position by the spring.

16. The partial-opening system according to claim 15, wherein the two jaws delimit between them a housing adapted to retain the retaining end-piece of the actuating element.

17. The partial-opening system according to claim 16, wherein the retaining end-piece, which is arranged on the free end of the actuating element, has a shape complementary to the shape of the housing, here a completely cylindrical shape.

18. The partial-opening system according to claim 17, wherein each jaw forms a ramp for opening the clamp.

19. The partial-opening system according to claim 16, wherein each jaw forms a ramp for opening the clamp.

20. The partial-opening system according to claim 15, wherein each jaw forms a ramp for opening the clamp.

* * * * *